US011235454B2

(12) United States Patent
Sabin et al.

(10) Patent No.: US 11,235,454 B2
(45) Date of Patent: Feb. 1, 2022

(54) SPRING LOADED ADJUSTABLE HEAD

(71) Applicant: Dynabrade, Inc., Clarence, NY (US)

(72) Inventors: Jeffrey Michael Sabin, West Seneca, NY (US); Frank D. Lehman, Wilson, NY (US); John Thomas Swaine, Tonawanda, NY (US)

(73) Assignee: Dynabrade, Inc., Clarence, NY (US)

( * ) Notice: Subject to any disclaimer, the term of this patent is extended or adjusted under 35 U.S.C. 154(b) by 252 days.

(21) Appl. No.: 16/710,653

(22) Filed: Dec. 11, 2019

(65) Prior Publication Data

US 2020/0223052 A1 Jul. 16, 2020

Related U.S. Application Data

(60) Provisional application No. 62/792,131, filed on Jan. 14, 2019.

(51) Int. Cl.
*B25F 5/02* (2006.01)

(52) U.S. Cl.
CPC ..... *B25F 5/02* (2013.01)

(58) Field of Classification Search
CPC ..... B25F 5/02; B25F 1/02; B25F 1/04; B24B 23/02; B24B 23/005; B24B 27/0084; B24B 45/006
USPC ..... 173/29, 39
See application file for complete search history.

(56) References Cited

U.S. PATENT DOCUMENTS 5,515,754 A * 5/1996 Elkins ..... B25G 1/066 403/106
5,533,581 A * 7/1996 Barth ..... B23Q 5/045 173/216
5,725,422 A * 3/1998 Leweck ..... B24B 23/005 16/426
5,803,680 A * 9/1998 Diener ..... B23Q 17/2404 356/241.1
6,102,134 A * 8/2000 Alsruhe ..... B25F 5/02 173/170
6,601,483 B2 8/2003 Wannop
6,776,499 B2 * 8/2004 Chang ..... B25B 13/481 362/119
7,278,342 B1 10/2007 Chang
7,503,921 B2 * 3/2009 Berthusen ..... A61B 17/1624 606/80
7,927,036 B2 * 4/2011 Reasoner ..... F16G 11/10 403/341

(Continued)

FOREIGN PATENT DOCUMENTS

| | | |
|---|---|---|
| DE | 102013211992 | 1/2015 |
| TW | I386279 B | 2/2013 |
| WO | WO2015/048700 | 4/2015 |

*Primary Examiner* — Dariush Seif
(74) *Attorney, Agent, or Firm* — Simpson & Simpson, PLLC; Michael Nicholas Vranjes

(57) ABSTRACT

An adjustable mechanism for an angle drill or a die grinder, including a receiver, including a first section, and a second section connected to the first section, a mating component, a tension component arranged on the second section, and an axial sliding support operatively arranged to be secured to the second section, wherein at least one of the first section and the mating component includes a plurality of holes and the other of the first section and the mating component includes one or more pins, the one or more pins being operatively arranged to removably engage the plurality of holes.

20 Claims, 12 Drawing Sheets

(56) References Cited

U.S. PATENT DOCUMENTS

| | | | | |
|---|---|---|---|---|
| 8,671,809 | B1 | 3/2014 | Chen | |
| 2005/0235785 | A1 | 10/2005 | Chang | |
| 2006/0260446 | A1 | 11/2006 | Chang | |
| 2008/0012245 | A1* | 1/2008 | Peters | B23B 51/12 279/5 |
| 2012/0160529 | A1* | 6/2012 | Eshleman | B25B 23/00 173/1 |
| 2012/0317771 | A1* | 12/2012 | Zhang | F01D 25/285 29/402.01 |
| 2013/0199811 | A1* | 8/2013 | Maddilate | B25F 5/02 173/170 |
| 2015/0075830 | A1 | 3/2015 | Zhang et al. | |
| 2015/0354635 | A1* | 12/2015 | Mcclymont | B23B 39/14 408/126 |
| 2017/0232593 | A1 | 8/2017 | Coffland | |
| 2018/0065233 | A1* | 3/2018 | Seith | B25B 21/02 |
| 2018/0236630 | A1* | 8/2018 | Yasuda | B24B 37/107 |
| 2018/0236641 | A1 | 8/2018 | Hu | |
| 2019/0009398 | A1* | 1/2019 | Zhong | B25B 21/00 |
| 2019/0084133 | A1* | 3/2019 | Hafele | B25B 13/465 |

* cited by examiner

SPRING LOADED ADJUSTABLE HEAD

CROSS-REFERENCE TO RELATED APPLICATIONS

This application claims the benefit under 35 U.S.C. § 119(e) of U.S. Provisional Application No. 62/792,131, filed Jan. 14, 2019, which application is incorporated herein by reference in its entirety.

FIELD

The present disclosure relates to mechanical or powered abrasive tools, more particularly, to handheld angle die grinders, and, even more particularly, to handheld angle drill or die grinders having a spring loaded adjustable head.

BACKGROUND

Handheld angle drill and die grinders and other handheld abrading or abrasive tools are common in the prior art having been available to the general public for several decades. One problem common to handheld (portable) angle drill or die grinders and other handheld mechanical or powered tools is the set angle of the abrasive device (e.g., disc, wheel, pad, etc.) with respect to the handle. In order to utilize the tool in small compact spaces, it is often necessary to change the angle or position of the drill or abrasive component relative to the handle. Traditionally, in order to alter the angle or position of the abrasive component relative to the handle, a tool is required in order to loosen the abrasive component. Once loosened, the drill bit or abrasive component is positioned in a correct angle, and then tightened back down to the handle. However, this can be time consuming and, if the angle needs to be changed often, is very inconvenient. Another technique is for the user to rotate the tool by bending the wrist and/or arm to position the tool. This is not ergonomic.

Thus, there is a long-felt need for a handheld angle die grinder that has a rotatable head such that the abrasive component can be quickly and easily rotated to any angle relative to the handle.

SUMMARY

According to aspects illustrated here, there is provided an adjustable mechanism for an angle drill or a die grinder, comprising a receiver, including a first section, and a second section connected to the first section, a mating component, a tension component arranged on the second section, and an axial sliding support operatively arranged to be secured to the second section, wherein at least one of the first section and the mating component includes a plurality of holes and the other of the first section and the mating component includes one or more pins, the one or more pins being operatively arranged to removably engage the plurality of holes.

According to aspects illustrated herein, there is provided an angle rotation device, comprising an adjustable mechanism, including a receiver, including a first section, and a second section connected to the first section, a mating component arranged to engage the receiver, a tension component arranged on the second section, and an axial sliding support operatively arranged to be secured to the second section, an adjustable head connected to the mating component, and a motor connected to the receiver, wherein at least one of the first section and the mating component includes a plurality of holes and the other of the first section and the mating component includes one or more pins, the one or more pins being operatively arranged to removably engage the plurality of holes.

According to aspects illustrated herein, there is provided an adjustable head for an angle drill or die grinder, comprising a receiver including a first section including a plurality of holes, and a second section connected to the first section, a mating component including one or more pins, the one or more pins being operatively arranged to removably engage the plurality of holes, a tension component arranged on the second section, and an axial sliding support operatively arranged to be secured to the second section.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" or "non-rotatably secured" elements, we mean that: the elements are connected so that whenever one of the elements rotate, all the elements rotate; and relative rotation between the elements is not possible. Radial and/or axial movement of non-rotatably connected elements with respect to each other is possible, but not required. By "rotatably connected" elements, we mean that the elements are rotatable with respect to each other.

Moreover, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Figure 1:
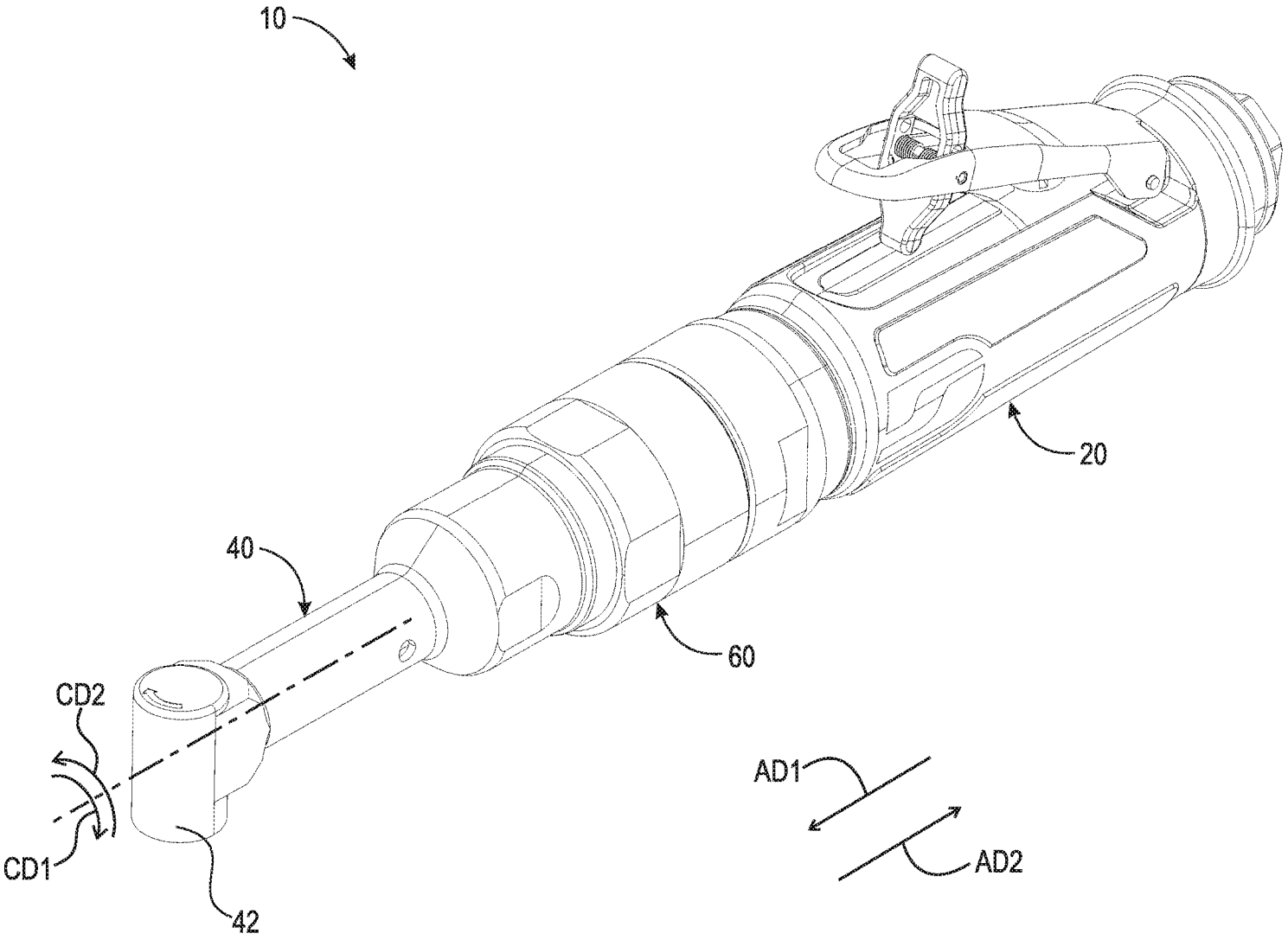
FIG. 1 is a perspective view of an angle drill having an adjustable head.
Figure 2A:
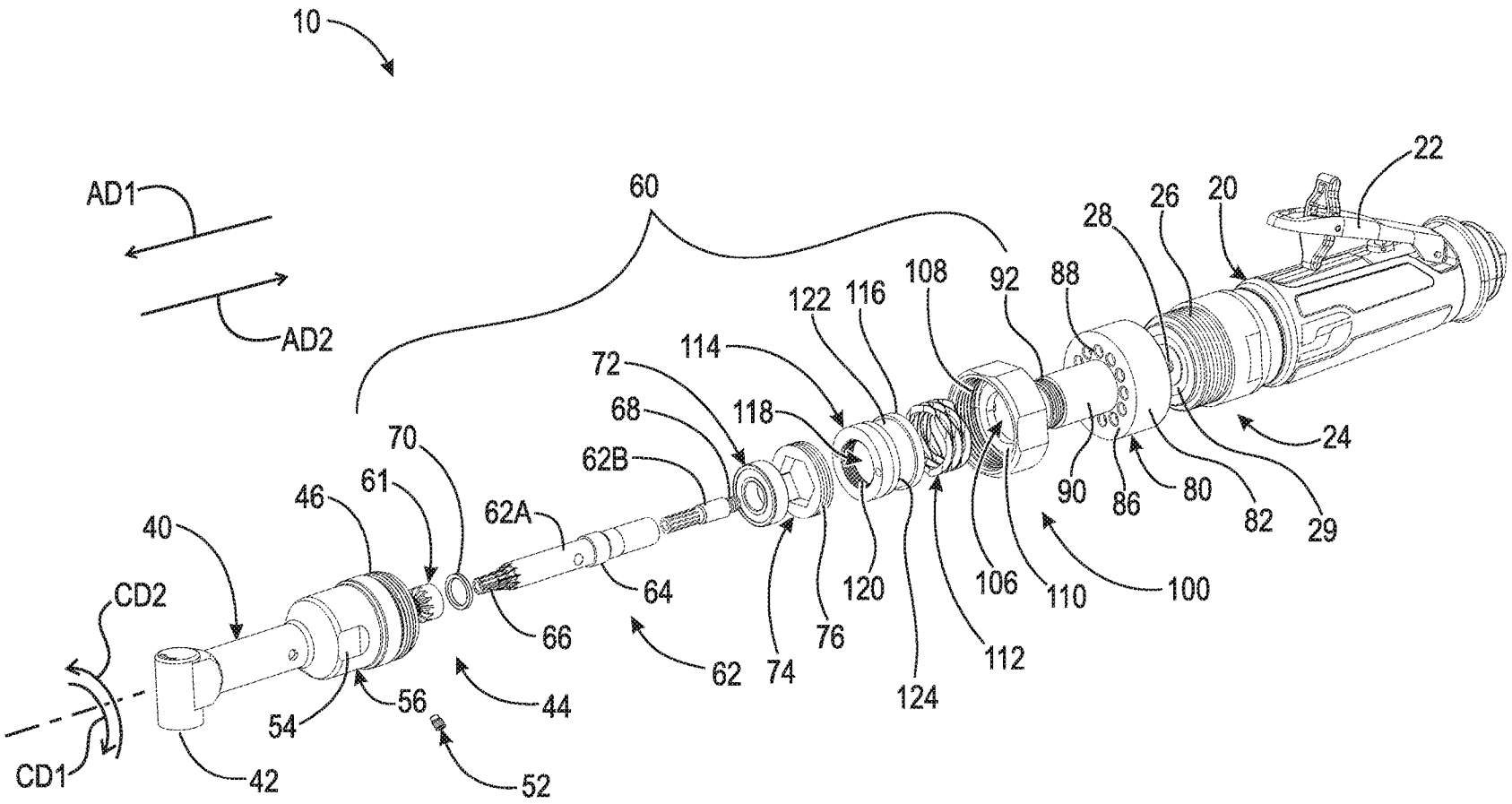
FIG. 2A is a front perspective exploded view of the angle drill shown in FIG. 1.
Figure 2B:
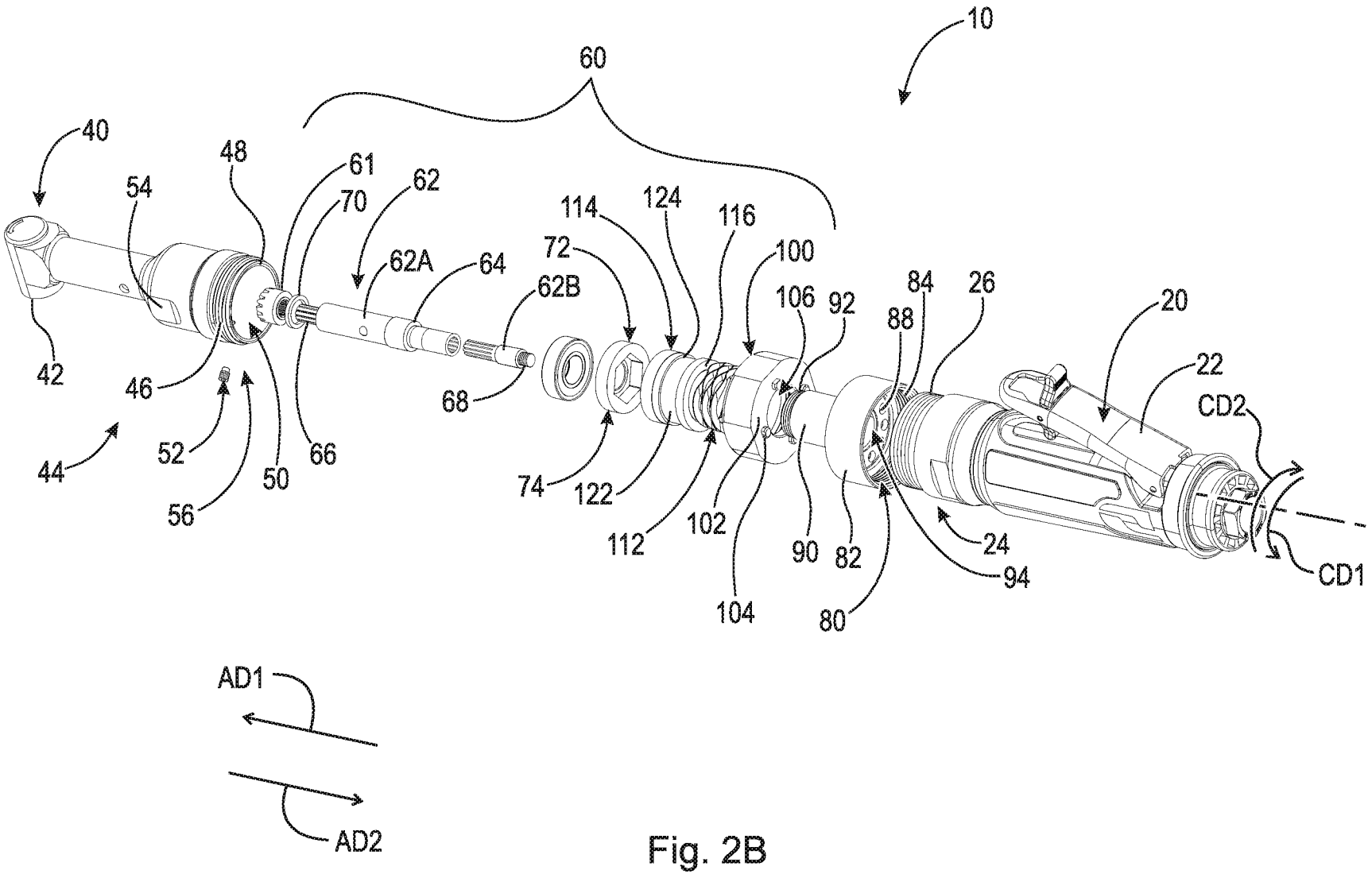
FIG. 2B is a rear perspective exploded view of the angle drill shown in FIG. 1.
Figure 3:
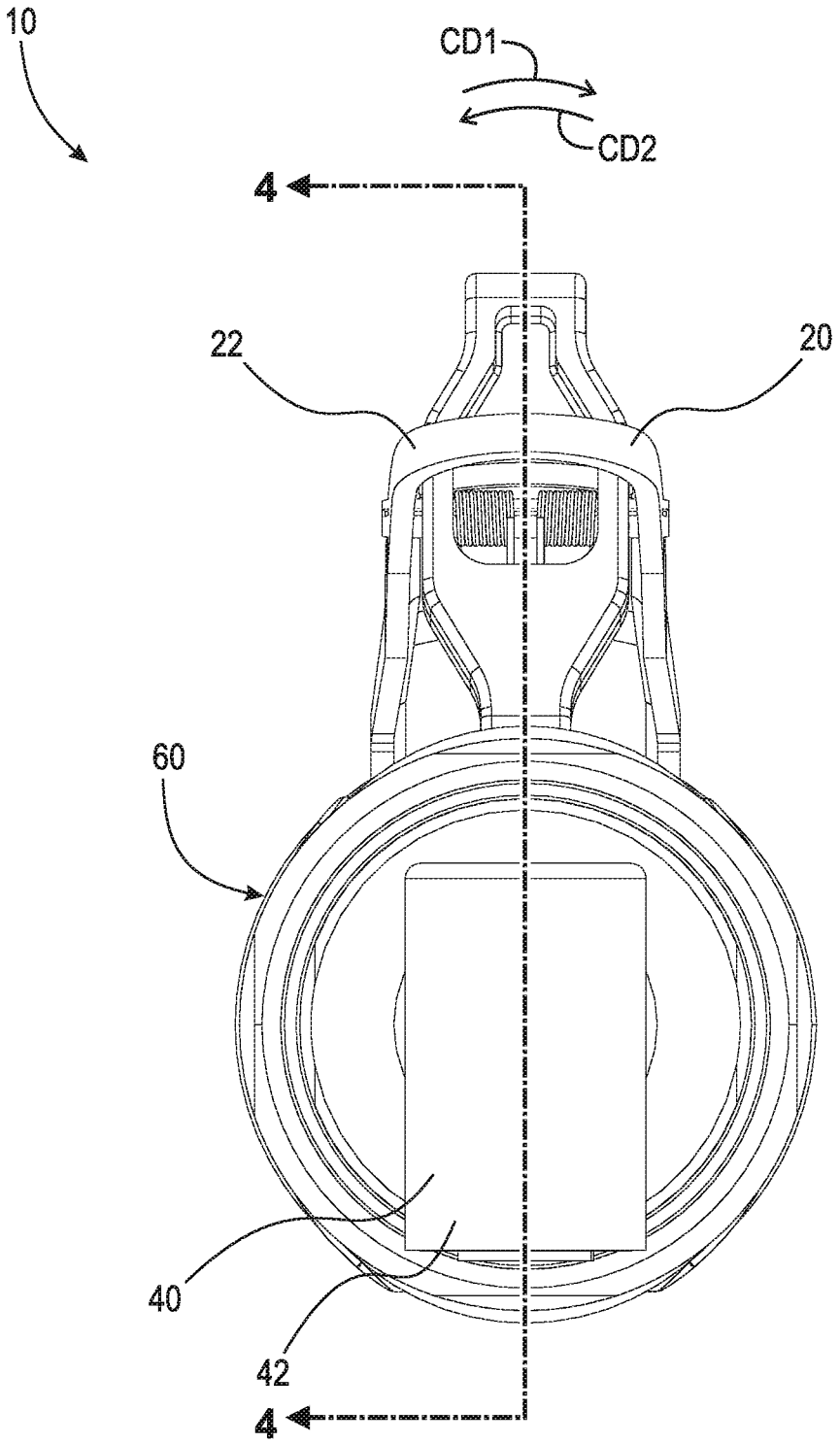
FIG. 3 is a front elevational view of the angle drill shown in FIG. 1.
Figure 4:
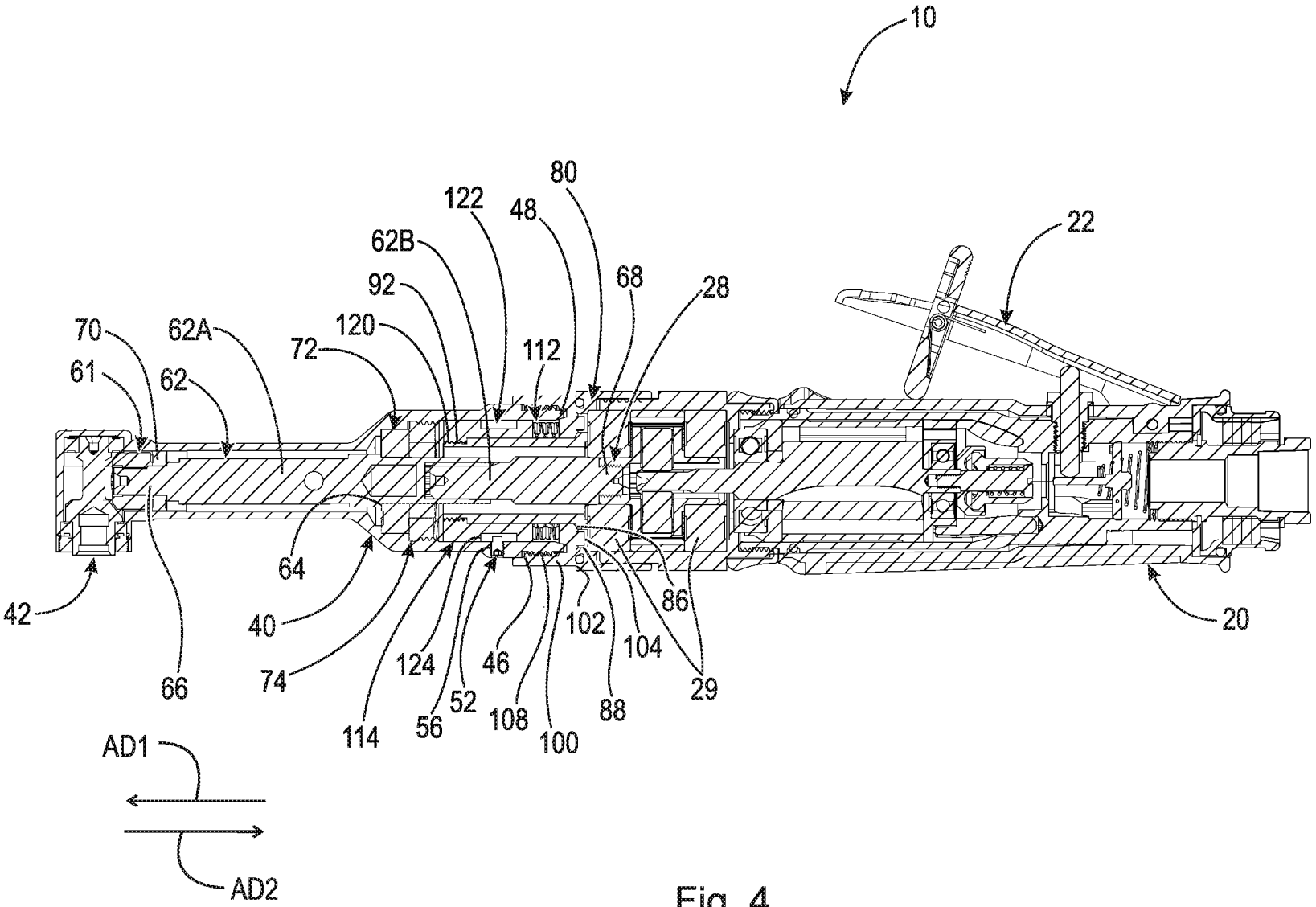
FIG. 4 is a cross-sectional view of the angle drill taken generally along line 4-4 in FIG. 3, in a rotatably locked position.

Adverting now to the figures, FIG. 1 is a perspective view of angle drill, die grinder, or angle rotation device 10 having adjustable head 40. FIG. 2A is a front perspective exploded view of angle drill 10. FIG. 2B is a rear perspective exploded view of angle drill 10. FIG. 3 is a front elevational view of angle drill 10. FIG. 4 is a cross-sectional view of angle drill 10 taken generally along line 4-4 in FIG. 3, in a rotatably locked position. Angle drill 10 generally comprises motor 20, adjustable head 40, and adjustable mechanism 60. The following description should be read in view of FIGS. 1-4.

Motor 20 generally comprises motor trigger 22 and end 24. Motor 20 is operatively arranged to drive shaft 62 as will be described in greater detail below. End 24 comprises radially outward facing surface 26 and coupler 28. Radially outward facing surface 26 may comprise threading arranged to engage threading on radially inward facing surface 84 of receiver 80. Coupler 28 is generally supported by bearing 29 having a hole in end 24 comprising a threaded inward facing surface. In some embodiments, coupler 28 comprises a plurality of radially inward extending teeth, similar to that of an annular gear. Coupler 28 is operatively arranged to rotate relative to radially outward facing surface 26 and motor trigger 22, and therefore rotate shaft 62 with respect to radially outward facing surface 26 and motor trigger 22. In order to activate motor 20, motor trigger 22 is pressed or displaced toward motor 20 (i.e., squeezed), which action rotates coupler 28, thus causing shaft 62 and chuck 42 to rotate. Motor trigger 22 may further comprise a safety lock to prevent activation of motor 20.

Adjustable head 40 comprises chuck 42 and end 44, end 44 being arranged opposite chuck 42. Chuck 42 is operatively arranged to engage a tool (not shown), for example, a grinding wheel, drill bit, hole saw, screw or securement device driver, or other rotation tool. Chuck 42 may also comprise a spindle. End 44 comprises radially outward facing surface 46, which may comprise threading. Adjustable head 40 is operatively arranged to connect to mating component 100, for example, via threaded engagement of radially outward facing surface 46 and radially inward facing surface 108. Adjustable head 40 further comprises hole 50 which extends at least partially therethrough. Hole 50 forms one or more radially inward facing surfaces within adjustable head 40. End 44 may further comprise frusto-conical taper 48 on radially inward facing surface formed by hole 50. Frusto-conical taper 48 allows for better alignment and fastening capabilities when adjustable head 40 is being secured to mating component 100. For example, as adjustable head 40 is being screwed into mating component 100 (e.g., via threading on radially outward facing surface 46 and radially inward facing surface 108), frusto-conical taper 48 engages surface 110 to further align and secure the components. Additionally, frusto-conical taper 48 may engage axial sliding support 114 to help align adjustable head 40, such that it can be slid over axial sliding support 114 and engage mating component 100, as will be described in greater detail below.

Adjustable head 40 further comprises shaft 62. Shaft 62 comprises end 66, and 68, and edge 64 arranged between ends 66 and 68. End 66 may comprise a plurality of teeth and end 68 may comprise a plurality of teeth. In some embodiments, end 68 comprises threading. End 66 is operatively arranged to non-rotatably connect to pinion gear 61, which is arranged at least partially in or proximate to chuck 42. Shaft 62 is arranged to rotate in circumferential direction CD1 and/or circumferential direction CD2, thus rotating pinion gear 61. Pinion gear 61 engages another gear within chuck 42 which changes the rotation direction at an angle (e.g., 90°), hence an "angle drill." Shaft 62 is rotatably connected to adjustable head 40 via bearing 70, bearing 72, and shaft lock 74. Bearing 72 is arranged to engage edge 64 and, together with shaft lock 74, rotatably secure shaft 62 to adjustable head 40 and prevent axial displacement of shaft 62 in axial direction AD1 and AD2 relative to adjustable head 40. In an example embodiment, shaft lock 74 comprises radially outward facing surface 76 that is connected to a radially inward facing surface of hole 50, for example, via threaded engagement (see FIG. 4). It should be appreciated, however, that shaft lock 74 may be secured to adjustable head 40 via any suitable means, for example, adhesives, rivets, screws, bolts, welding, soldering, etc. End 68 is arranged to engage motor 20, specifically coupler 28. In some embodiments, the threading of end 68 engages the threading of coupler 28. The plurality of teeth of end 68 engage the plurality of teeth of coupler 28. In some embodiments, shaft 62 comprises two sections, section 62A and section 62B. As shown, section 62A engages adjustable head 40 and section 62B engages motor 20. Sections 62A and 62B may be connected via any suitable means, for example, splines (e.g., external splines on section 62B and internal splines on section 62A or vice versa), hexagonal engagement, octagonal engagement, etc. It should be appreciated that section 62A is operatively arranged to be displaceable in axial direction AD1 with respect to section 62B, for example, during the adjustment of adjustable head 40 with respect to motor trigger 22. The connection between sections 62A and 62B allow axial displacement while maintaining rotatable connection therebetween. The use of a two section shaft reduces vibration in angle drill 10 during operation.

In some embodiments, adjustable head 40 further comprises hole 56 and stop 52. Hole 56 extends through radially outward facing surface 46 and into hole 50. Stop 52 is operatively arranged to engage hole 56 and at least partially extend into hole 50 to engage groove 122 of axial sliding support 114 (see FIG. 4). The function of stop 52 and hole 56 is to prevent the over displacement of adjustable head 40 with respect to motor 20 and receiver 80, as will be described in greater detail below. Stop 52 is arranged to engage surface 124 of groove 122 and prevent further displacement of adjustable head 40 in axial direction AD1 relative to receiver 80. In some embodiments, adjustable head 40 further comprises one or more grips 54. Grips 54 allow a user to more easily rotate adjustable head 40, in circumferential directions CD1 and CD2, with respect to motor 20.

Adjustable mechanism 60 comprises receiver 80, mating component 100, tension component 112, and axial sliding support 114.

Receiver 80 is operatively arranged to be connected to motor 20, specifically end 24, and comprises section 82, section 90, and through-bore 94 that extends through sections 82 and 90. Section 82 comprises radially inward facing surface 84, which may include threading, and axial facing surface 86. In some embodiments, radially inward facing surface 84 is non-rotatably secured to radially outward facing surface 26 via threaded engagement. However, it should be appreciated that receiver 80 may be connected to end 24 via any suitable means, for example, adhesives, welding, soldering, bolts, screws, rivets, dowels, etc. Surface 86 comprises a plurality of holes 88 arranged therein. Holes 88 are operatively arranged to engage pins 104 and non-rotatably connect mating component 100 and receiver 80, as will be described in greater detail below. In some embodiments, mating component 100 is rotatable with respect to receiver 80. It should be appreciated that surface 86 may comprise any suitable number of holes arranged at any suitable location. For example, in some embodiments, surface 86 may comprise twelve holes 88 spaced apart by 30° about a center point. In some embodiments, surface 86 may comprise twenty holes 88 spaced apart by 18° about a center point. Section 90 is generally cylindrical or tubular and is connected to surface 86. In some embodiments, section 90 is fixedly secured to section 82. In some embodiments, section 90 is rotatably connected to section 82. In some embodiments, sections 82 and 90 are integrally formed. Section 90 is arranged to engage mating component 100, tension component 112, and axial sliding support 114. In some embodiments, section 90 comprises threading 92.

Mating component 100 is operatively arranged to engage receiver 80. Mating component 100 comprises surface 102, radially inward facing surface 108, surface 110, and through-bore 106 extending therethrough. Surface 102 is operatively arranged to engage and/or abut against surface 86. Surface 102 comprises one or more pins 104 operatively arranged to engage holes 88. In a rotatably locked position, surface 102 engages and/or abuts against surface 86, pins 104 are at least partially engaged with holes 88, and mating component 100 is non-rotatably connected to receiver 80 and thus motor 20. In a rotatably unlocked position, axial gap AG is formed between surface 102 and surface 86 (see FIGS. 5A-C), pins 104 are fully disengaged with holes 88, and mating component 100 is rotatable in circumferential directions CD1 and CD2 with respect to receiver 80 and thus motor 20. Through-bore 106 is arranged to engage section 90. Mating component 100 is arranged to non-rotatably connect to adjustable head 40. In some embodiments, radially inward facing surface 108 comprises threading which threadably engages threading on radially outward facing surface 46. It should be appreciated that although the present disclosure illustrates a threaded connection, any means for suitably connecting adjustable head 40 and mating component 100 may be used, for example, adhesives, welding, soldering, bolts, screws, rivets, pins, dowels, etc. Surface 110 is operatively arranged to engage frusto-conical taper 48 to help align and connect adjustable head 40 and mating component 100. Surface 110 is also arranged to engage tension component 112.

Tension component 112 and axial sliding support 114 are operatively arranged on section 90 to bias mating component 100 in axial direction AD2 relative to receiver 80. Tension component 112 may be any biasing element suitable for biasing mating component 100 toward receiver 80, for example, a stacked wave spring (e.g., a CREST-TO-CREST® wave spring), a compression spring, etc. Tension component 112 is axially arranged between axial sliding support 114 and mating component 100, specifically, surface 116 and surface 110, respectively. Axial sliding support 114 comprises through-bore 118 arranged to engage section 90 and radially inward facing surface 120. Axial sliding support 114 is operatively arranged to be secured to section 90. In some embodiments, radially inward facing surface 120 comprises threading that engages with threading 92. It should be appreciated, however, that axial sliding support 114 may be connected to section 90 via any suitable means, for example, adhesives, welding, soldering, bolts, rivets, pins, dowels, etc. In effect, the arrangement of axial sliding support 114 and tension component 112 biases mating component 100 toward the rotatably locked position (i.e., surface 102 engages and/or abuts against surface 86, pins 104 are at least partially engaged with holes 88, and mating component 100 is non-rotatably connected to receiver 80 and thus motor 20). Axial sliding support 114 further provides a guide or support on which the radially inward facing surface formed by hole 50 of adjustable head 40 may slide (i.e., axial sliding support 114 provides stability to the sliding/rotating adjustable head 40). Since adjustable head 40 is secured to mating component 100, to disengage pins 104 from holes 88, adjustable head 40 is displaced in axial direction AD1 relative to motor 20. This action compresses tension component 112. Since pins 104 are no longer engaged with holes 88, adjustable head 40 may be circumferentially displaced in circumferential directions CD1 or CD2 relative to motor 20. Once the desired assembly is reached (e.g., chuck 42 is arranged at a 30° angle relative to motor trigger 22), adjustable head 40 is released. Tension component 112 forces mating component 100 and thus adjustable head 40 in axial direction AD2 relative to motor 20, and pins 104 re-engage holes 88 to non-rotatably connect mating component 100 (and adjustable head 40) with receiver 80 (and motor 20). As previously described, axial sliding support 114 further comprises groove 122 having surface 124. Groove 122 and surface 124, along with hole 56 and stop 52, provide a limit on total axial displacement of mating component 100 relative to receiver 80, and thus adjustable head 40 relative to motor 20, in axial direction AD1. When mating component 100 and adjustable head 40 are at the maximum axial displacement, stop 52 will engage surface 124 thereby preventing any additional displacement in axial direction AD1 relative to receiver 80. This assembly may prevent over compression of tension component and thus preserves the longevity of tension component 112.

Figure 5A:
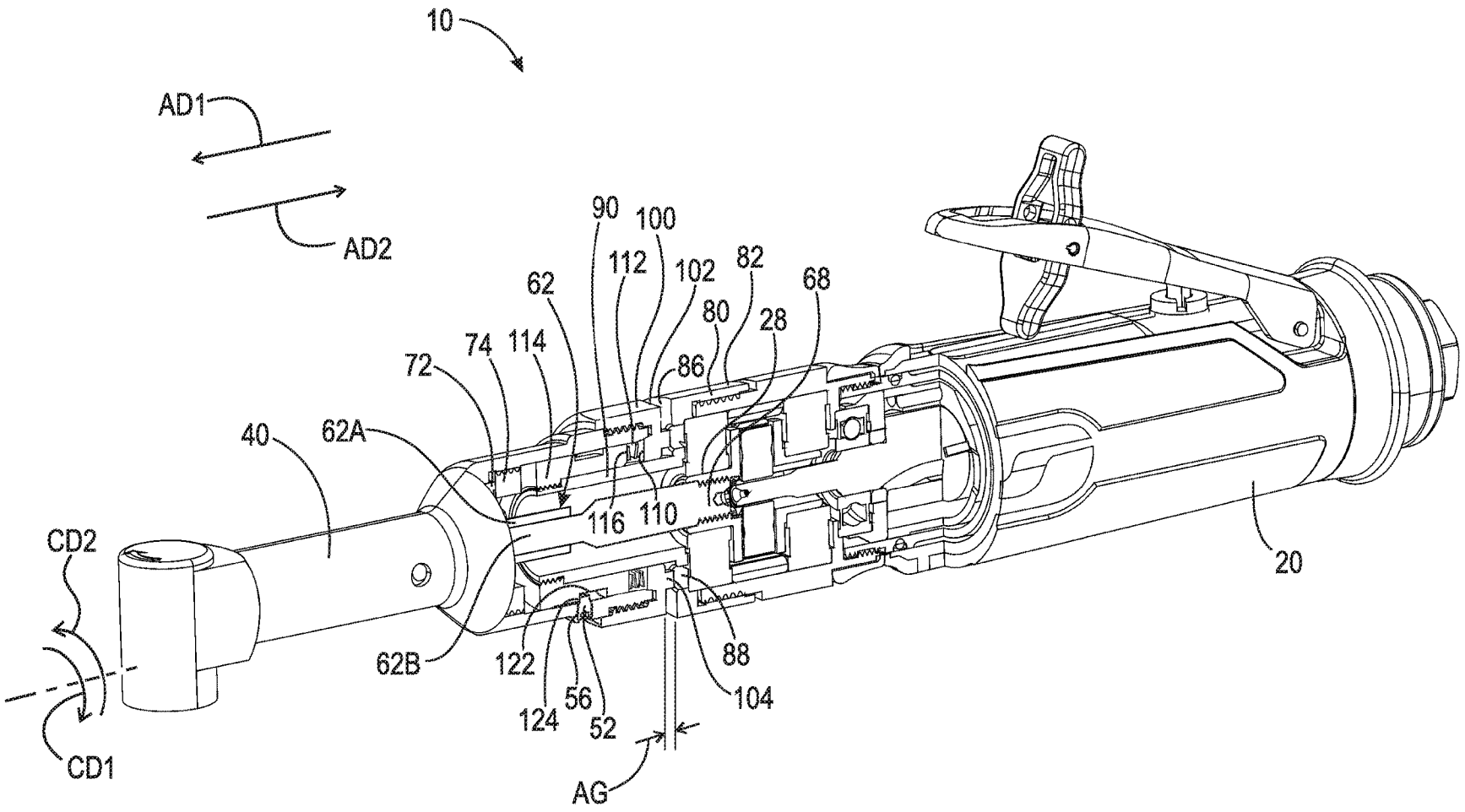
FIG. 5A is a partial sectional view of the angle drill shown in FIG. 1, in a rotatably unlocked position.

FIG. 5A is a partial sectional view of angle drill 10, in a rotatably unlocked position. To shift from the rotatably locked position, as shown in FIG. 4, to the rotatably unlocked position, as shown in FIG. 5A, adjustable head 40 is displaced in axial direction AD1 relative to motor 20 (i.e., away from motor 20). When angle drill 10 is in the rotatably unlocked position, axial gap AG is formed between surface 102 and surface 86, pins 104 of mating component 100 are fully disengaged from holes 88 of receiver 80, and mating component 100 and thus adjustable head 40 is rotatable in circumferential directions CD1 and CD2 with respect to receiver 80 and thus motor 20. In the rotatably unlocked position, tension component 112 is in a first state of compression and adjustable head 40 is rotatable with respect to motor 20.

Figure 5B:
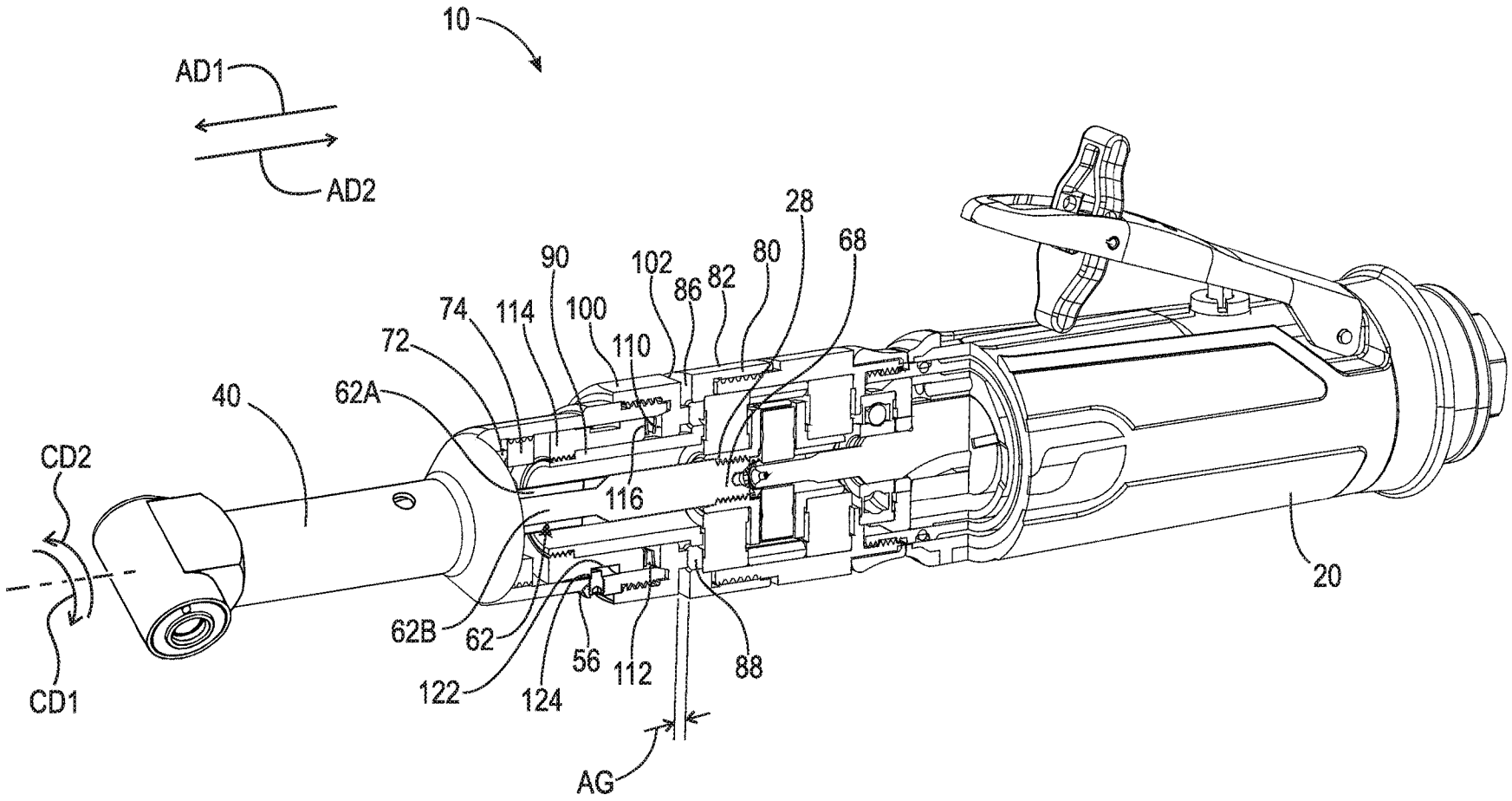
FIG. 5B is a partial sectional view of the angle drill shown in FIG. 1, in a rotatably unlocked position.

FIG. 5B is a partial sectional view of angle drill 10, in a rotatably unlocked position. As shown, adjustable head 40 has been rotated in circumferential direction CD2 relative to motor assembly 20. Tension component 112 is exerting a force on mating component 100 in axial direction AD2 biasing mating component 100 toward receiver 80. In the rotatably unlocked position, adjustable head 40 may be rotated with respect to motor 20 since pins 104 of mating component 100 are completely disengaged from holes 88 of receiver 80. Adjustable head 40 should be rotated in circumferential direction CD1 or circumferential direction CD2 until a desired angle is reached and pins 104 align with holes 88.

Figure 5C:
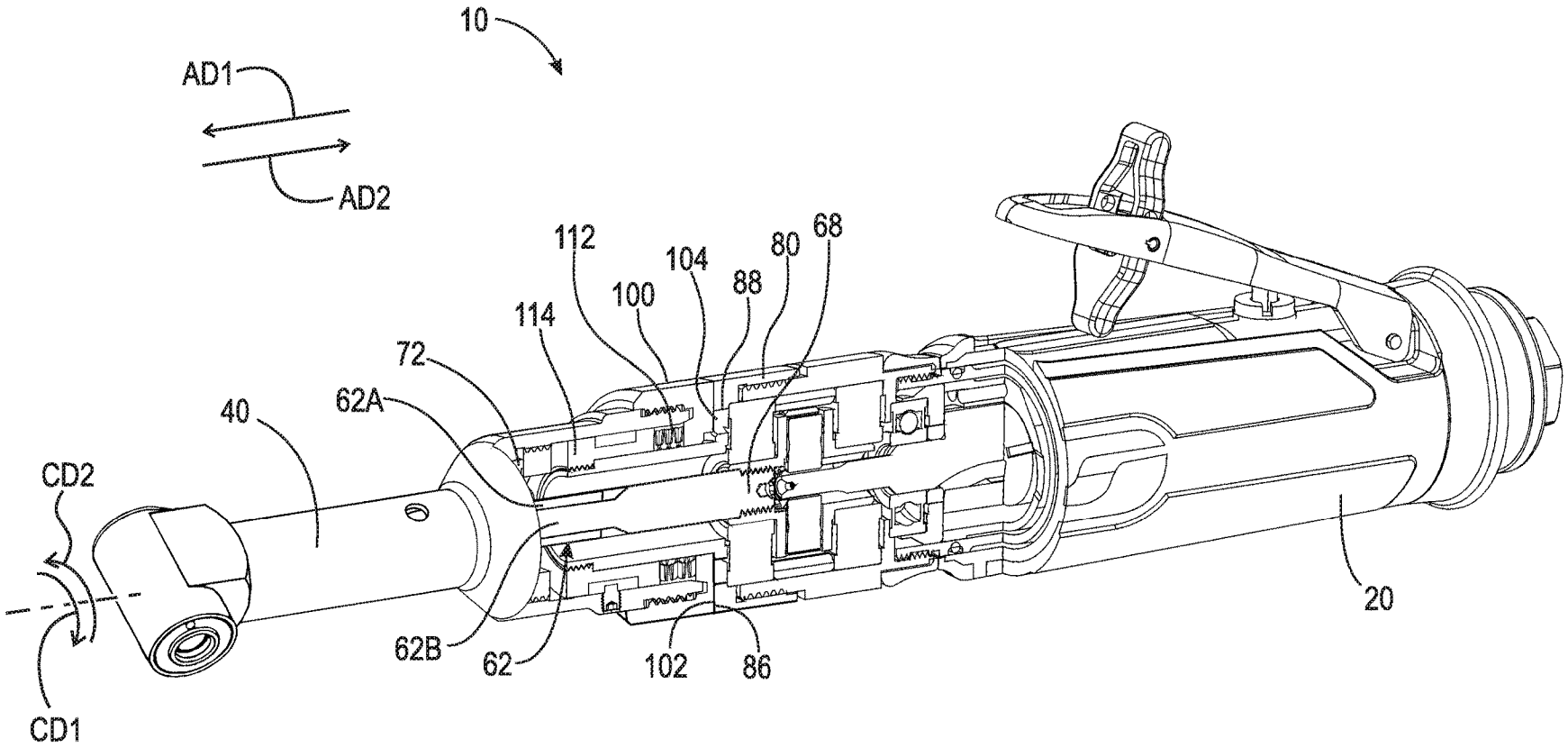
FIG. 5C is a partial sectional view of the angle drill shown in FIG. 1, in a rotatably locked position.

FIG. 5C is a partial sectional view of angle drill 10, in a rotatably locked position. In a rotatably locked position, surface 102 engages and/or abuts against surface 86, pins 104 of mating component 100 are at least partially engaged with holes 88 of receiver 80, and mating component 100 is non-rotatably connected to receiver 80 and thus motor 20. As previously described with respect to FIG. 5B, once adjustable head 40 is rotated to a desired angle with respect to motor 20, and pins 104 are aligned with holes 88, the force on adjustable head 40 in axial direction AD1 is released allowing tension component 112 to force mating component 100 back into engagement with receiver 80, thus rotatably locking adjustable head 40 with motor 20. In the rotatably locked position, tension component 112 is in a second state of compression, which is less than the first state of compression (i.e., tension component 112 exerts more force on mating component 100 in the first state of compression than in the second state of compression).

Generally, angle drill 10 is to be used in situations in which a user may want chuck 42 to be positioned at multiple angles throughout a job. Angle drill 10 allows the user to easily change the angle of chuck 42 (and the connected tool) relative to motor 20 and motor trigger 22 simply by pulling adjustable head 40 away from the motor 20 and rotating adjustable head 40 with respect to motor 20 until a suitable angle is reached. Adjustable head 40 is then released and tension component 112 forces adjustable head 40 back toward motor 20.

Figure 6A:
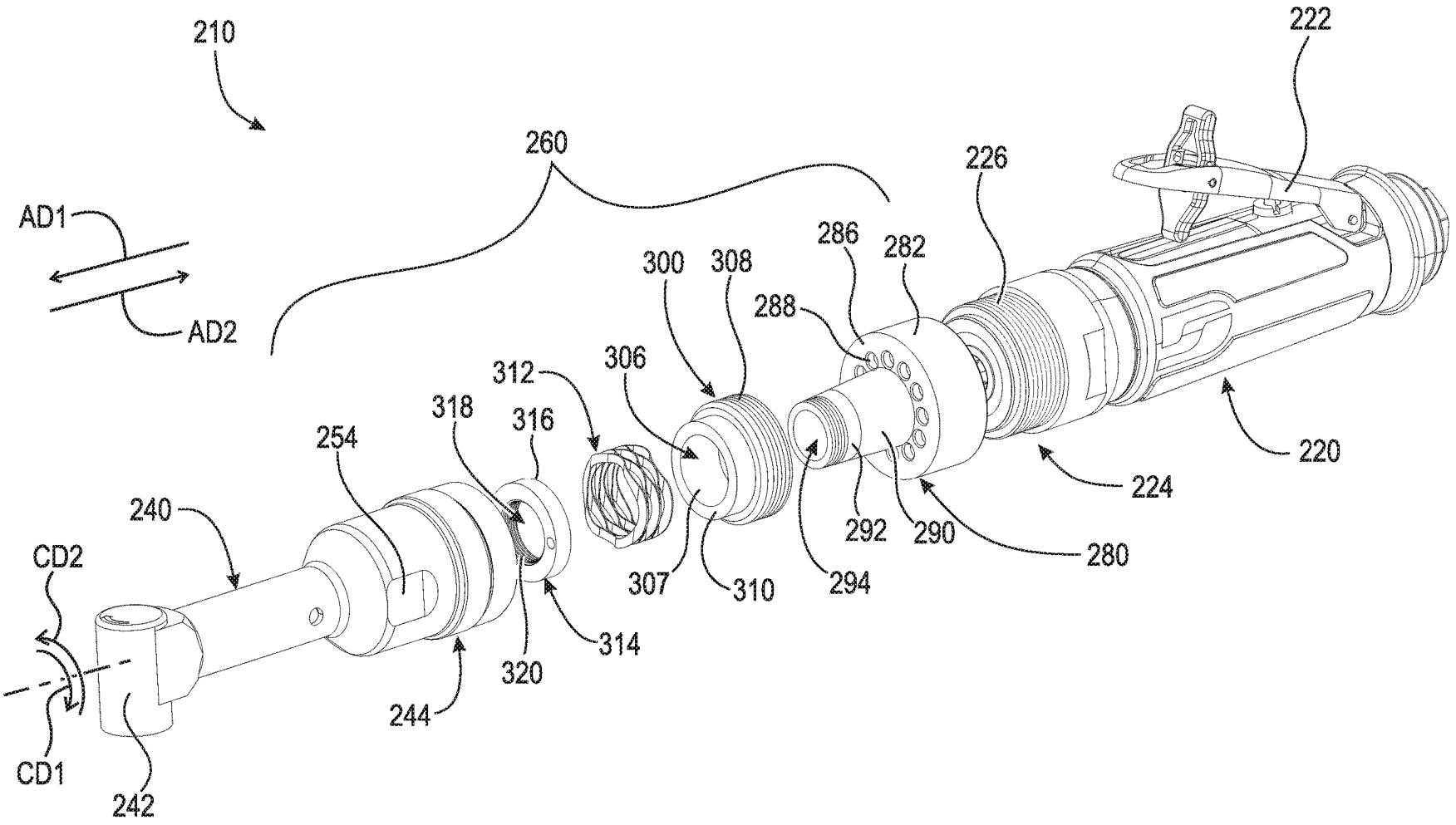
FIG. 6A is a front perspective exploded view of an angle drill having an adjustable head.
Figure 6B:
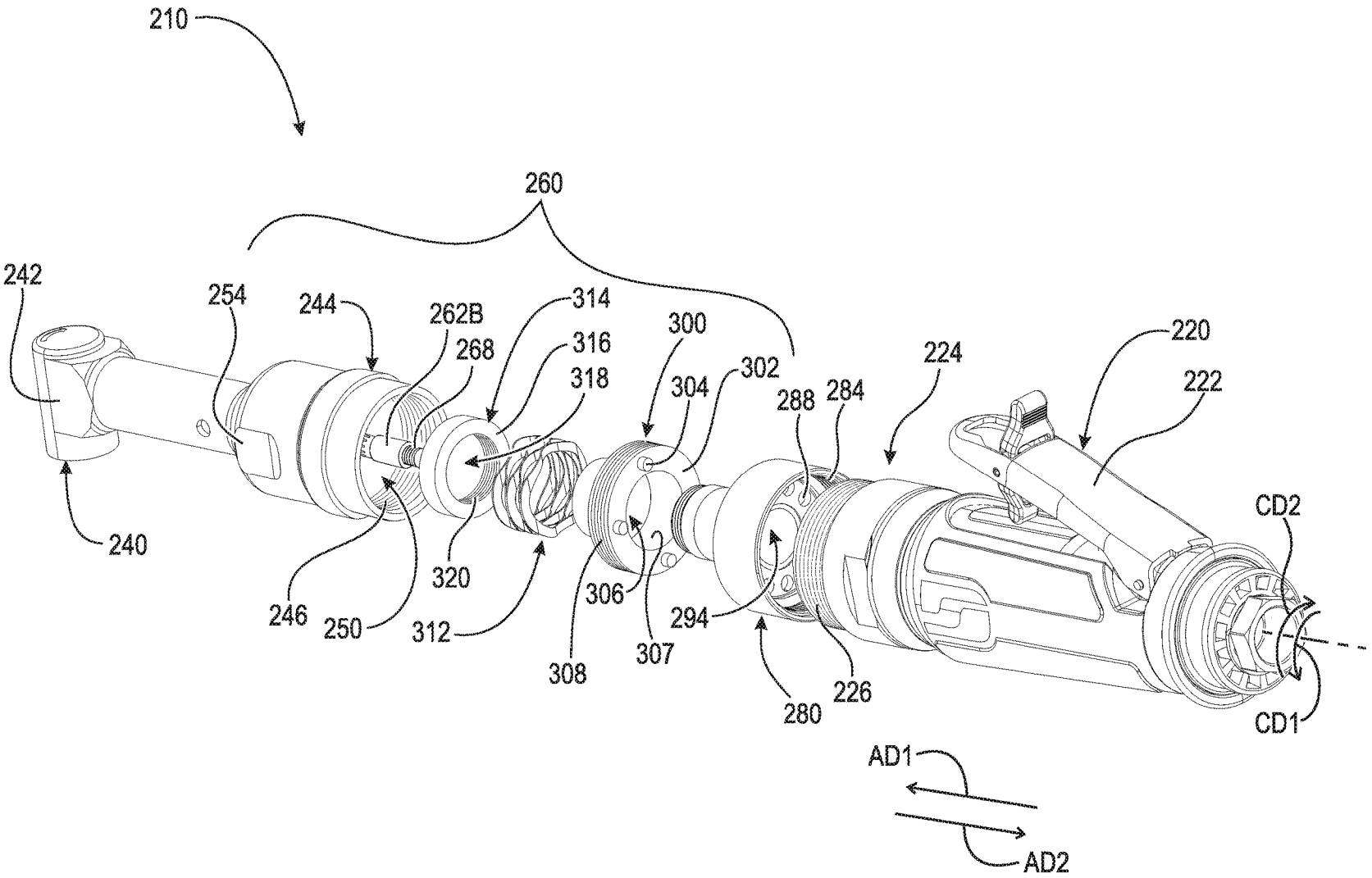
FIG. 6B is a rear perspective exploded view of the angle drill shown in FIG. 6A.
Figure 7:
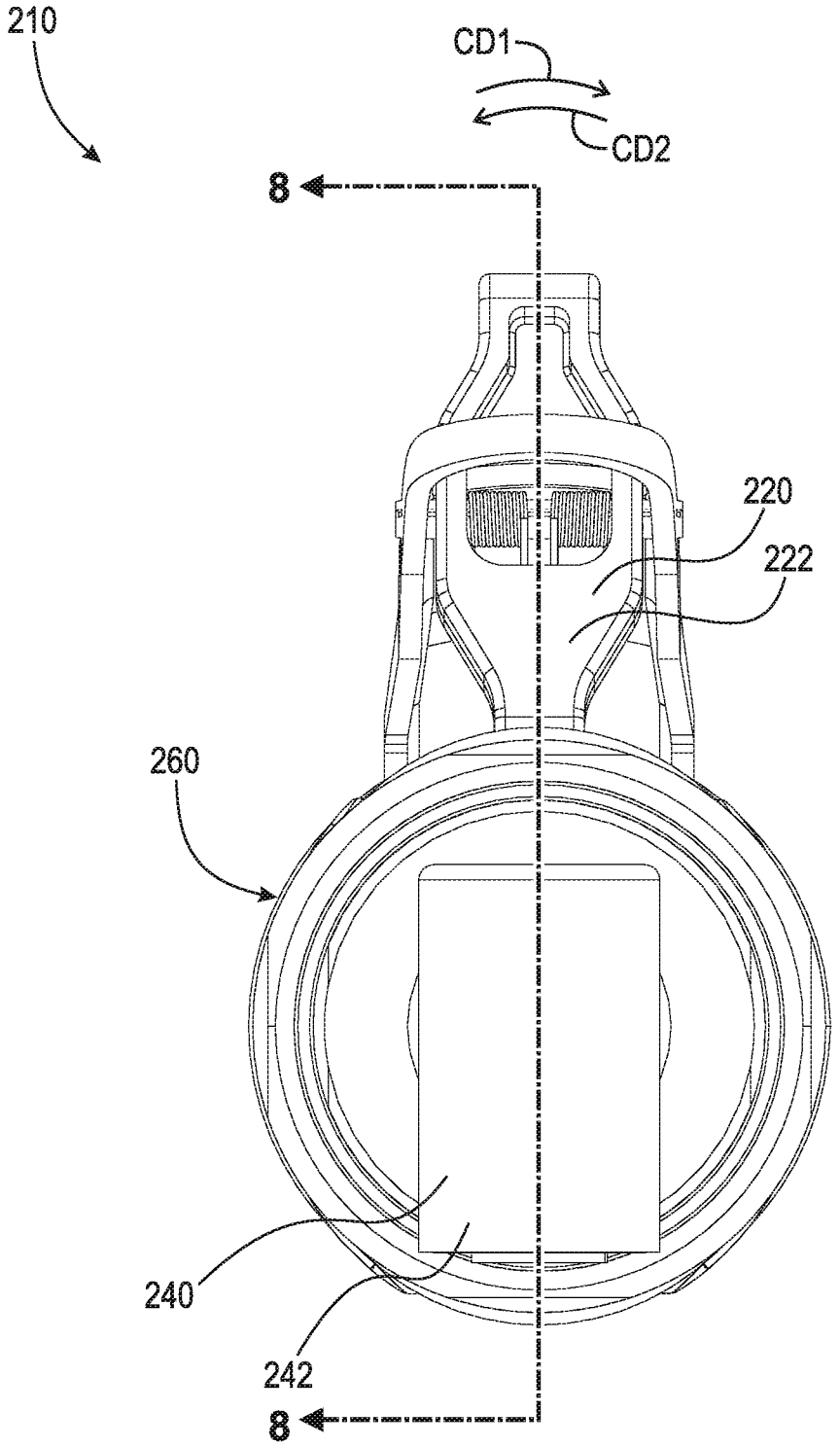
FIG. 7 is a front elevational view of the angle drill shown in FIG. 6A; and, FIG. 8 is a cross-sectional view of the angle drill taken generally along line 8-8 in FIG. 7.
Figure 8:
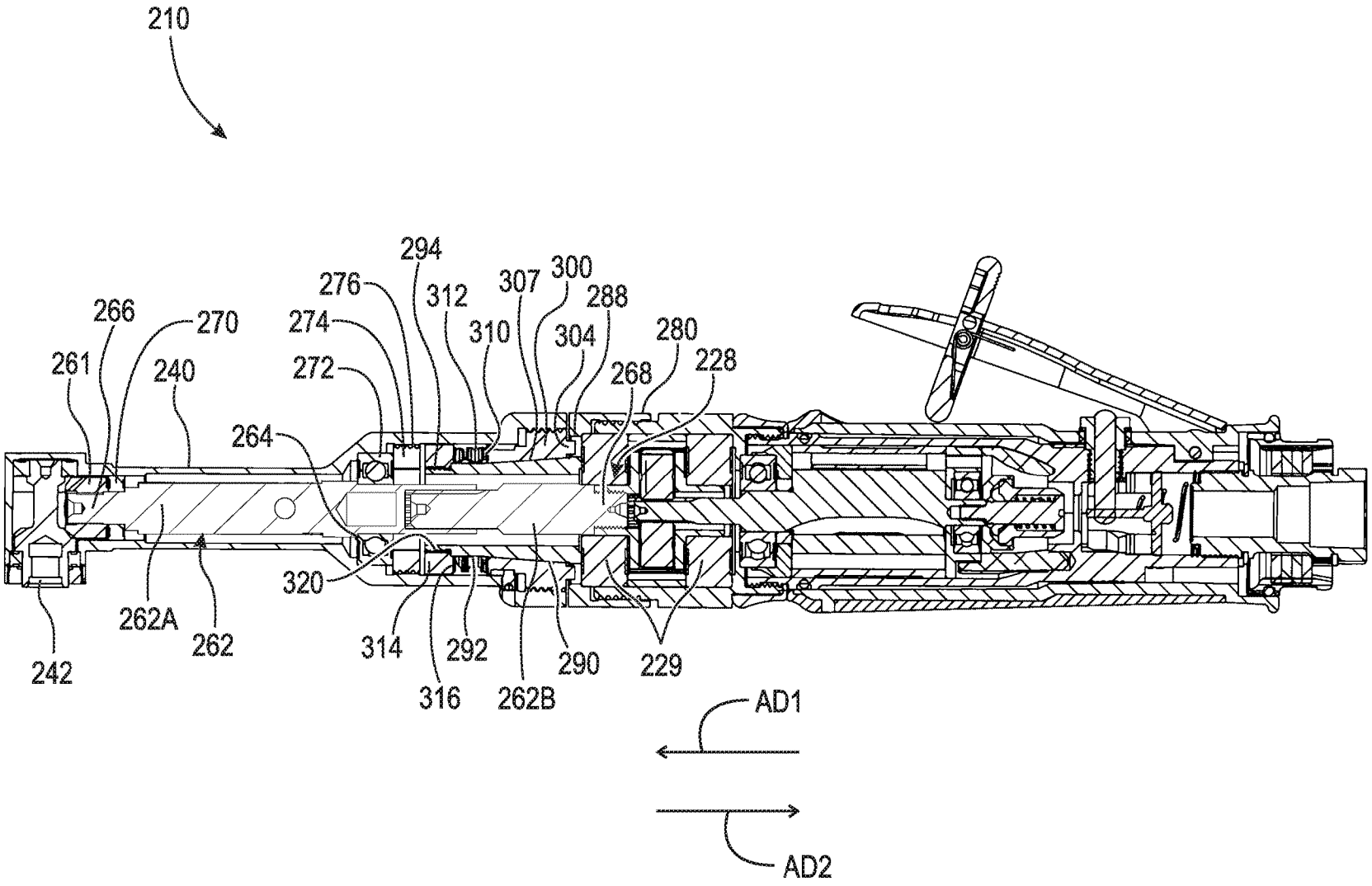

FIG. 6A is a front perspective exploded view of angle drill, die grinder, or angle rotation device 210 having adjustable head 240. FIG. 6B is a rear perspective exploded view of angle drill 210. FIG. 7 is a front elevational view of angle drill 210. FIG. 8 is a cross-sectional view of angle drill 210 taken generally along line 8-8 in FIG. 7, in a rotatably locked position. Angle drill 210 generally comprises motor 220, adjustable head 240, and adjustable mechanism 260. The following description should be read in view of FIGS. 6A-7.

Motor 220 generally comprises motor trigger 222 and end 224. Motor 220 is operatively arranged to drive shaft 262 as will be described in greater detail below. End 224 comprises radially outward facing surface 226 and coupler 228. Radially outward facing surface 226 may comprise threading arranged to engage threading on radially inward facing surface 284 of receiver 280. Coupler 228 is generally supported by bearing 229 having a hole in end 224 comprising a threaded inward facing surface. In some embodiments, coupler 228 comprises a plurality of radially inward extending teeth, similar to that of an annular gear. Coupler 228 is operatively arranged to rotate relative to radially outward facing surface 226 and motor trigger 222, and therefore rotate shaft 262 with respect to radially outward facing surface 226 and motor trigger 222. In order to activate motor 220, motor trigger 222 is pressed or displaced toward motor 220 (i.e., squeezed), which action rotates coupler 228, thus causing shaft 262 and chuck 242 to rotate. Motor trigger 222 may further comprise a safety lock to prevent unintended activation of motor 220.

Adjustable head 240 comprises chuck 242 and end 244, end 244 being arranged opposite chuck 242. Chuck 242 is operatively arranged to engage a tool (not shown), for example, a grinding wheel, drill bit, hole saw, screw or securement device driver, or other rotation tool. Chuck 242 may also comprise a spindle. End 244 comprises radially inward facing surface 246, which may comprise threading. Adjustable head 240 is operatively arranged to connect to mating component 300, for example, via threaded engagement of radially inward facing surface 246 and radially outward facing surface 308. Adjustable head 240 further comprises hole 250 which extends at least partially therethrough. Hole 250 forms one or more radially inward facing surfaces within adjustable head 240.

Adjustable head 240 further comprises shaft 262. Shaft 262 comprises end 266, and 268, and edge 264 arranged between ends 266 and 268. End 266 may comprise a plurality of teeth and end 268 may comprise a plurality of teeth. In some embodiments, end 268 comprises threading. End 266 is operatively arranged to non-rotatably connect to pinion gear 261, which is arranged at least partially in or proximate to chuck 242. Shaft 262 is arranged to rotate in circumferential direction CD1 and/or circumferential direction CD2, thus rotating pinion gear 261. Pinion gear 261 engages another gear within chuck 242 which changes the rotation direction at an angle (e.g., 90°), hence an "angle drill." Shaft 262 is rotatably connected to adjustable head 240 via bearing 270, bearing 272, and shaft lock 274. Bearing 272 is arranged to engage edge 264 and, together with shaft lock 274, rotatably secure shaft 262 to adjustable head 240 and prevent axial displacement of shaft 262 in axial direction AD1 and AD2 relative to adjustable head 240. In an example embodiment, shaft lock 274 comprises radially outward facing surface 276 that is connected to a radially inward facing surface of hole 250, for example, via threaded engagement (see FIG. 8). It should be appreciated, however, that shaft lock 274 may be secured to adjustable head 240 via any suitable means, for example, adhesives, rivets, screws, bolts, welding, soldering, etc. End 268 is arranged to engage motor 220, specifically coupler 228. In some embodiments, the threading of end 268 engages the threading of coupler 228. The plurality of teeth of end 268 engage the plurality of teeth of coupler 228. In some embodiments, adjustable head 240 further comprises one or more grips 254. Grips 254 allow a user to more easily rotate adjustable head 240, in circumferential directions CD1 and CD2, with respect to motor 220. In some embodiments, shaft 262 comprises two sections, section 262A and section 262B. As shown, section 262A engages adjustable head 240 and section 262B engages motor 220. Sections 262A and 262B may be connected via any suitable means, for example, splines (e.g., external splines on section 262B and internal splines on section 262A or vice versa), hexagonal engagement, octagonal engagement, etc. It should be appreciated that section 262A is operatively arranged to be displaceable in axial direction AD1 with respect to section 262B, for example, during the adjustment of adjustable head 240 with respect to motor trigger 222. The connection between sections 262A and 262B allow axial displacement while maintaining rotatable connection therebetween. The use of a two section shaft reduces vibration in angle drill 210 during operation.

Adjustable mechanism 260 comprises receiver 280, mating component 300, tension component 312, and spring stop 314.

Receiver 280 is operatively arranged to be connected to motor 220, specifically end 224, and comprises section 282, section 290, section 292, and through-bore 294 that extends through sections 282, 290, and 292. Section 282 comprises radially inward facing surface 284, which may include threading, and axial facing surface 286. In some embodiments, radially inward facing surface 284 is non-rotatably secured to radially outward facing surface 226 via threaded engagement. However, it should be appreciated that receiver 280 may be connected to end 224 via any suitable means, for example, adhesives, welding, soldering, bolts, screws, rivets, dowels, etc. Surface 286 comprises a plurality of holes 288 arranged therein. Holes 288 are operatively arranged to engage pins 304 and non-rotatably connect mating component 300 and receiver 280, as will be described in greater detail below. It should be appreciated that surface 286 may comprise any suitable number of holes arranged at any suitable location. For example, in some embodiments, surface 286 may comprise twelve holes 288 spaced apart by 30° about a center point. In some embodiments, surface 286 may comprise twenty holes 288 spaced apart by 18° about a center point. Section 290 is generally frusto-conical and is connected to surface 286. Section 292 is generally cylindrical and is connected to section 290. Sections 290 and 292 are arranged to engage mating component 300, tension component 312, and spring stop 314. In some embodiments, section 292 comprises threading.

Mating component 300 is operatively arranged to engage receiver 280. Mating component 300 comprises surface 302, radially outward facing surface 308, surface 310, and through-bore 306 extending therethrough and forming radially inward facing surface 307. Surface 302 is operatively arranged to engage and/or abut against surface 286. Surface 302 comprises one or more pins 304 operatively arranged to engage holes 288. In a rotatably locked position, surface 302 engages and/or abuts against surface 286, pins 304 are at least partially engaged with holes 288, and mating component 300 is non-rotatably connected to receiver 280 and thus motor 220. In a rotatably unlocked position, axial gap AG is formed between surface 302 and surface 286 (see FIGS. 5A-C), pins 304 are fully disengaged with holes 288, and mating component 300 is rotatable in circumferential directions CD1 and CD2 with respect to receiver 280 and thus motor 220. Through-bore 306 is arranged to engage section 292 and section 290. Specifically, frusto-conical section 290 is arranged to engage frusto-conical radially inward facing surface 307. Frusto-conical section 290 in this embodiment has a similar function to axial sliding support 114 of FIGS. 1-5C; it offers stability when mating component 300 is engaged with receiver 280, but less stability when these components are disengaged since the conical surface becomes separated. Therefore, it has more movement/displacement potential. Mating component 300 is arranged to non-rotatably connect to adjustable head 240. In some embodiments, radially outward facing surface 308 comprises threading which threadably engages threading on radially outward facing surface 246. It should be appreciated that although the present disclosure illustrates a threaded connection, any means for suitably connecting adjustable head 240 and mating component 300 may be used, for example, adhesives, welding, soldering, bolts, screws, rivets, pins, dowels, etc. Surface 310 is operatively arranged to engage tension component 312.

Tension component 312 and spring stop 314 are operatively arranged on sections 290 and 292 to bias mating component 300 in axial direction AD2 relative to receiver 280. Tension component 312 may be any biasing element suitable for biasing mating component 300 toward receiver 280, for example, a stacked wave spring (e.g., a CREST-TO-CREST® wave spring), a compression spring, etc. Tension component 312 is axially arranged between spring stop 314 and mating component 300, specifically, surface 316 and surface 310, respectively. Spring stop 314 comprises through-bore 318 arranged to engage section 292 and radially inward facing surface 320. Spring stop 314 is operatively arranged to be secured to section 292. In some embodiments, radially inward facing surface 320 comprises threading that engages with threading of section 292. It should be appreciated, however, that spring stop 314 may be connected to section 292 via any suitable means, for example, adhesives, welding, soldering, bolts, rivets, pins, dowels, etc. In effect, the arrangement of spring stop 314 and tension component 312 biases mating component 300 toward the rotatably locked position (i.e., surface 302 engages and/or abuts against surface 286, pins 304 are at least partially engaged with holes 288, surface 307 is engaged with or arranged proximate to section 290, and mating component 300 is non-rotatably connected to receiver 280 and thus motor 220). Since adjustable head 240 is secured to mating component 300, to disengage pins 304 from holes 288, adjustable head 240 is displaced in axial direction AD1 relative to motor 220. This action compresses tension component 312. Since pins 304 are no longer engaged with holes 288, adjustable head 240 may be circumferentially displaced in circumferential directions CD1 or CD2 relative to motor 220. Once the desired assembly is reached (e.g., chuck 242 is arranged at a 30° angle relative to motor trigger 222 and pins 304 align with holes 288), adjustable head 240 is released. Tension component 312 forces mating component 300 and thus adjustable head 240 in axial direction AD2 relative to motor 220, and pins 304 re-engage holes 288 to non-rotatably connect mating component 300 (and adjustable head 240) with receiver 280 (and motor 220).

The operation of angle drill 210 is substantially similar to the operation of angle drill 10, as described in great detail above. Generally, angle drill 210 is to be used in situations in which a user may want chuck 242 to be positioned at multiple angles throughout a job. Angle drill 210 allows the user to easily change the angle of chuck 242 (and the connected tool) relative to motor 220 and motor trigger 222 simply by pulling adjustable head 240 away from the motor 220 and rotating adjustable head 240 with respect to motor 220 until a suitable angle is reached. Adjustable head 240 is then released and tension component 312 forces adjustable head 240 back toward motor 220.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Angle drill (or die grinder)
20 Motor
22 Motor trigger
24 End
26 Radially outward facing surface
28 Coupler
29 Bearing
40 Head
42 Chuck (or spindle)
44 End
46 Radially outward facing surface
48 Frusto-conical taper
50 Hole
52 Stop
54 Grip(s)
56 Hole
60 Adjustable mechanism
61 Pinion gear
62 Shaft
62A Section
62B Section
64 Edge
66 End
68 End
70 Bearing
72 Bearing
74 Shaft lock
76 Radially outward facing surface
80 Receiver
82 Section
84 Radially inward facing surface
86 Surface
88 Holes
90 Section
92 Threading
100 Mating component
102 Surface
104 Pin(s)
106 Through-bore
108 Radially inward facing surface
110 Surface
112 Tension component
114 Axial sliding support
116 Surface
118 Through-bore
120 Radially inward facing surface
122 Groove
124 Surface
210 Angle drill (or die grinder)
220 Motor
222 Motor trigger
224 End
226 Radially outward facing surface
228 Coupler
229 Bearing
240 Head
242 Chuck (or spindle)
244 End
246 Radially inward facing surface
250 Hole
254 Grip(s)
260 Adjustable mechanism
261 Pinion gear
262 Shaft
262A Section
262B Section
264 Edge
266 End
268 End
270 Bearing
272 Bearing
274 Shaft lock
276 Radially outward facing surface
280 Receiver
282 Section
284 Radially inward facing surface
286 Surface
288 Holes
290 Section
292 Section
294 Through-bore
300 Mating component
302 Surface
304 Pin(s)
306 Through-bore
307 Radially inward facing surface
308 Radially outward facing surface
310 Surface
312 Tension component
314 Spring stop
316 Surface
318 Through-bore
AG Axial gap
AD1 Axial direction
AD2 Axial direction
CD1 Circumferential direction
CD2 Circumferential direction

What is claimed is:

1. An adjustable mechanism for an angle drill or a die grinder, comprising:
- a receiver, including:
  - a first section; and,
  - a second section connected to the first section;
- a mating component;
- a tension component arranged on the second section; and,
- an axial sliding support operatively arranged to be secured to the second section;
- wherein at least one of the first section and the mating component includes a plurality of holes and the other of the first section and the mating component includes one or more pins, the one or more pins being operatively arranged to removably engage the plurality of holes.

2. The adjustable mechanism as recited in claim 1, wherein the first section includes the plurality of holes and the mating component includes the one or more pins.

3. The adjustable mechanism as recited in claim 1, wherein the second section is cylindrical.

4. The adjustable mechanism as recited in claim 1, wherein the second section is at least partially frusto-conical.

5. The adjustable mechanism as recited in claim 1, wherein the tension component biases the mating component in a first axial direction.

6. The adjustable mechanism as recited in claim 1, further comprising an adjustable head operatively arranged to be connected to the mating component.

7. The adjustable mechanism as recited in claim 6, wherein the adjustable head comprises a frusto-conical taper at an end, the end operatively arranged to engage the mating component.

8. The adjustable mechanism as recited in claim 6, wherein the adjustable head comprises a stop operatively arranged to limit axial movement of the mating component relative to the receiver.

9. The adjustable mechanism as recited in claim 8, wherein the axial sliding support comprises a groove having a surface, the stop being operatively arranged to engage the groove and the surface.

10. An angle rotation device, comprising:

an adjustable mechanism, including:

a receiver, including:

a first section; and, a second section connected to the first section;

a mating component arranged to engage the receiver;

a tension component arranged on the second section; and, an axial sliding support operatively arranged to be secured to the second section;

an adjustable head connected to the mating component; and, a motor connected to the receiver;

wherein at least one of the first section and the mating component includes a plurality of holes and the other of the first section and the mating component includes one or more pins, the one or more pins being operatively arranged to removably engage the plurality of holes.

11. The angle rotation device as recited in claim 10, wherein the first section includes the plurality of holes and the mating component includes the one or more pins.

12. The angle rotation device as recited in claim 10, wherein the second section is cylindrical.

13. The angle rotation device as recited in claim 10, wherein the second section is at least partially frusto-conical.

14. The angle rotation device as recited in claim 10, wherein when the adjustable head is in a rotatably locked position:

the one or more pins are at least partially engaged with the plurality of holes; and, the adjustable head is non-rotatably connected to the motor.

15. The angle rotation device as recited in claim 14, wherein when the adjustable head is in a rotatably unlocked position:

the one or more pins are disengaged from the plurality of holes; and, the adjustable head is rotatably connected to the motor.

16. The angle rotation device as recited in claim 15, wherein the tension component biases the mating component in a first axial direction, toward the rotatably locked position.

17. The angle rotation device as recited in claim 10, further comprising a shaft operatively arranged to connect the motor with the adjustable head.

18. The angle rotation device as recited in claim 17, wherein the shaft extends at least partially through the axial sliding support, the tension component, the mating component, and the receiver.

19. The angle rotation device as recited in claim 10, wherein the adjustable head comprises a stop operatively arranged to limit axial movement of the adjustable head relative to the motor.

20. The angle rotation device as recited in claim 19, wherein the axial sliding support comprises a groove having a surface, the stop being operatively arranged to engage the groove and the surface.

* * * * *